US007252329B1

(12) United States Patent
O'Meally

(10) Patent No.: US 7,252,329 B1
(45) Date of Patent: Aug. 7, 2007

(54) COMBINED LOUNGE CHAIR AND WATER MISTING DISPENSERS

(76) Inventor: Judith A. O'Meally, 117 Miami Gardens Rd., Hollywood, FL (US) 33023

( * ) Notice: Subject to any disclaimer, the term of this patent is extended or adjusted under 35 U.S.C. 154(b) by 27 days.

(21) Appl. No.: 11/254,205

(22) Filed: Oct. 20, 2005

(51) Int. Cl.
*A47C 7/74* (2006.01)
*A47C 4/00* (2006.01)
*A47C 4/28* (2006.01)

(52) U.S. Cl. ..... 297/180.15; 297/31; 297/900

(58) Field of Classification Search ..... 297/31, 297/180.15, 900
See application file for complete search history.

(56) References Cited

U.S. PATENT DOCUMENTS 4,765,542 A * 8/1988 Carlson ..... 297/180.15 X
4,846,525 A * 7/1989 Manning ..... 297/180.15
4,961,535 A * 10/1990 Skibik ..... 297/180.15 X
5,000,384 A 3/1991 Arnold
5,063,621 A 11/1991 Sellars
5,322,342 A * 6/1994 Gange ..... 297/180.15
5,613,731 A 3/1997 Aspinall
5,722,596 A 3/1998 Dome
5,823,617 A 10/1998 Schafer
6,089,655 A * 7/2000 Colman ..... 287/180.15
6,842,919 B2 1/2005 Wilson et al.
7,077,465 B1 * 7/2006 Calderon ..... 297/180.15
2004/0239156 A1 * 12/2004 Rosenberg ..... 297/180.15

* cited by examiner

*Primary Examiner*—Rodney B. White

(57) ABSTRACT

A lounge chair assembly includes a lounge chair including a hollow tubular frame for supporting a user's body thereon. The frame includes hollow shafts and hollow couplings in fluid communication therewith such that water flows through the shafts and couplings. The couplings are coextensively shaped for being interchangeably detachable to alternate portions of the frame. Selected shafts include a water port monolithically formed therewith, which are coextensively shaped for receiving multiple ones of the flexible hose. A flexible hose has opposed ends conjoined to one water port and to an external water supply source respectively for introducing water into the frame. A mechanism is included for discharging the water outwardly and away from the frame such that the water is dispensed in a fine mist over the user body while the user is lying on the lounge chair.

12 Claims, 3 Drawing Sheets

COMBINED LOUNGE CHAIR AND WATER MISTING DISPENSERS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lounge chairs and, more particularly, to a combined lounge chair and water misting dispensers.

2. Prior Art

Leisure in the sun involves anything from sunbathing for the purpose of tanning to napping or resting outdoors while exposed to the sun. However, one either perspires in the heat of the sun or, at the other extreme, dehydrates one's exposed skin. At either extreme, a refreshing spray of water is often needed. The many attempts to obtain such a spray have been complicated by considerations of construction integrity, the aesthetics of sun lounging chairs, and hydraulic engineering to obtain a water tight pressure system. Lounge furniture should be low cost, ergonomically adjustable, aesthetically pleasing, capable of withstanding hard outdoor use and even abuse, lightweight, and easily transported and stored. This has been achieved in the simple sun lounge, but not generally available in spray or misting lounges.

The obvious approach to the implementation of such a combination is to start with a lounge chair having a tubular frame, and use sections of the frame to act as water conduits. A known example of such an approach discloses a mist chair where the rectangular, tubular frame of a cot is connected to a source of pressurized water through a water hose. Small orifices drilled along the length of the tubular frame act as spray nozzles to create a fine mist around the body-supporting portion of the cot.

This prior art technique is fraught with many disadvantages. In the first place, the tubular frames of most outdoor lounge chairs are not intended to carry water, and most often do not provide open connections between sections of the frame. For instance, right-angle and T-joints may be implemented with connecting hardware having no internal pass-through channels. Secondly, the tubular frame may be drilled at various points to accommodate hooks, and other types of fasteners for the body supporting web or netting. These holes constitute unwanted or unnecessary leakage points. Moreover, the tubular elements or the hardware components attached to or passing through them may offer little resistance to corrosion. Finally, elements of the frame may be joined by hinges and other types of articulation which do not provide a continuous fluid channel therethrough.

Accordingly, a need remains for a combined lounge chair and water misting dispensers in order to overcome the above-noted shortcomings. The present invention satisfies such a need by providing a combined lounge chair and mist dispenser that is easy and convenient to use, durable and lightweight in design, and provides the user with increased comfort. Such a lounge chair is utilizable by homeowners who enjoy spending time sunbathing on an outdoor recliner. The lounge chair also appealing to commercial/institutional facilities where lounge chairs are employed. Such facilities include public swimming pools, water parks, hotels/motels, resorts, and cruise ships, to name a few.

BRIEF SUMMARY OF THE INVENTION

In view of the foregoing background, it is therefore an object of the present invention to provide a combined lounge chair and water misting dispensers. These and other objects, features, and advantages of the invention are provided by a lounge chair assembly for providing cooling and refreshing mist during operating conditions.

The lounge chair assembly includes a lounge chair including a hollow tubular frame suitably sized and shaped for supporting an entire body of a user thereon. Such a tubular frame includes a plurality of hollow shafts and a plurality of hollow couplings in fluid communication therewith such that water effectively flows in a unidirectional path directly through an entire surface area of the hollow shafts and the hollow couplings. The couplings are coextensively shaped for advantageously and conveniently being interchangeably detachable to alternate portions of the tubular frame.

Selected ones of the hollow shafts include a water port monolithically formed therewith. Such water ports are coextensively shaped for effectively receiving multiple ones of the flexible hose (described herein below) during operating conditions. The one water port is preferably situated adjacent to one of the couplings and adjacent to an arm of the user so that the flexible hose can advantageously and conveniently be reached by the user while the user is resting on the lounge chair. The other water port may be situated adjacent to a head of the user for conveniently and effectively allowing the user to selectively position the water discharging mechanism without having to move away from the lounge chair. A flexible hose has opposed end portions directly conjoined to one of the water ports and to an external water supply source respectively for effectively introducing fresh water into the tubular frame.

A mechanism is included for discharging the water outwardly and away from the frame such that the water is conveniently dispensed in a fine mist over the user body while the user is laying on the lounge chair. Such a water discharging mechanism preferably includes an elongated tubular rod that has a threaded opening formed at a bottom end thereof. The tubular rod is removably and threadably engageable directly with another water port such that the tubular rod and the frame become adapted in fluid communication with each other. A discharge spout is monolithically connected with a top end of the tubular rod. Such a spout has an arcuate shape for effectively directing and depositing the water mist directly onto the user body while the tubular rod extends vertically upward along and over the user body. A rotary shut-off valve is operably connected directly to the tubular rod and disposed upstream of the other water port such that the operator can conveniently selectively toggle the water discharge mechanism between operating and non-operating modes while the water supply source is retained at an on position. Such a shut-off valve is preferably spaced downstream from the spout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
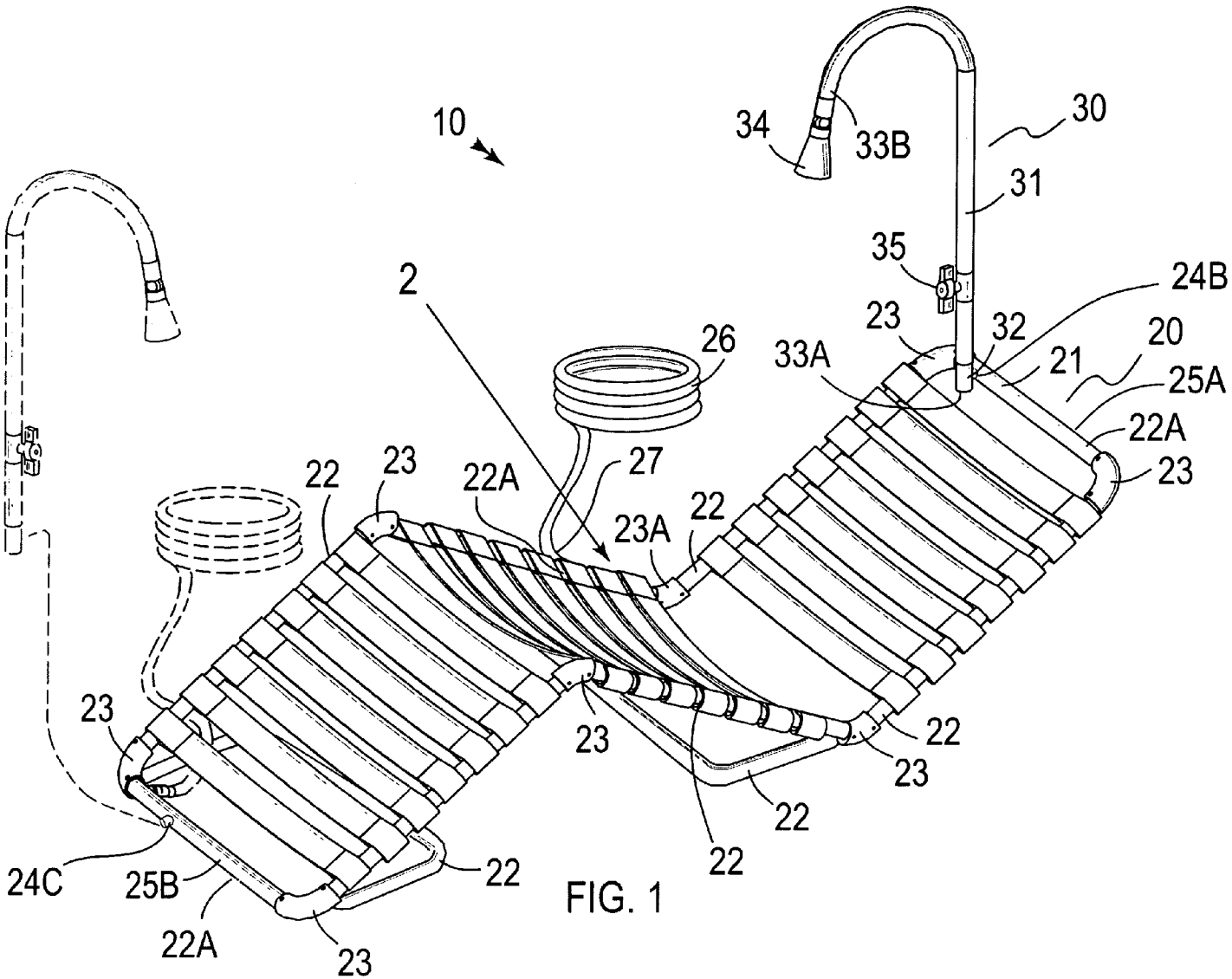
FIG. 1 is a perspective view showing a combined lounge chair and water misting dispensers, in accordance with the present invention.
Figure 2:
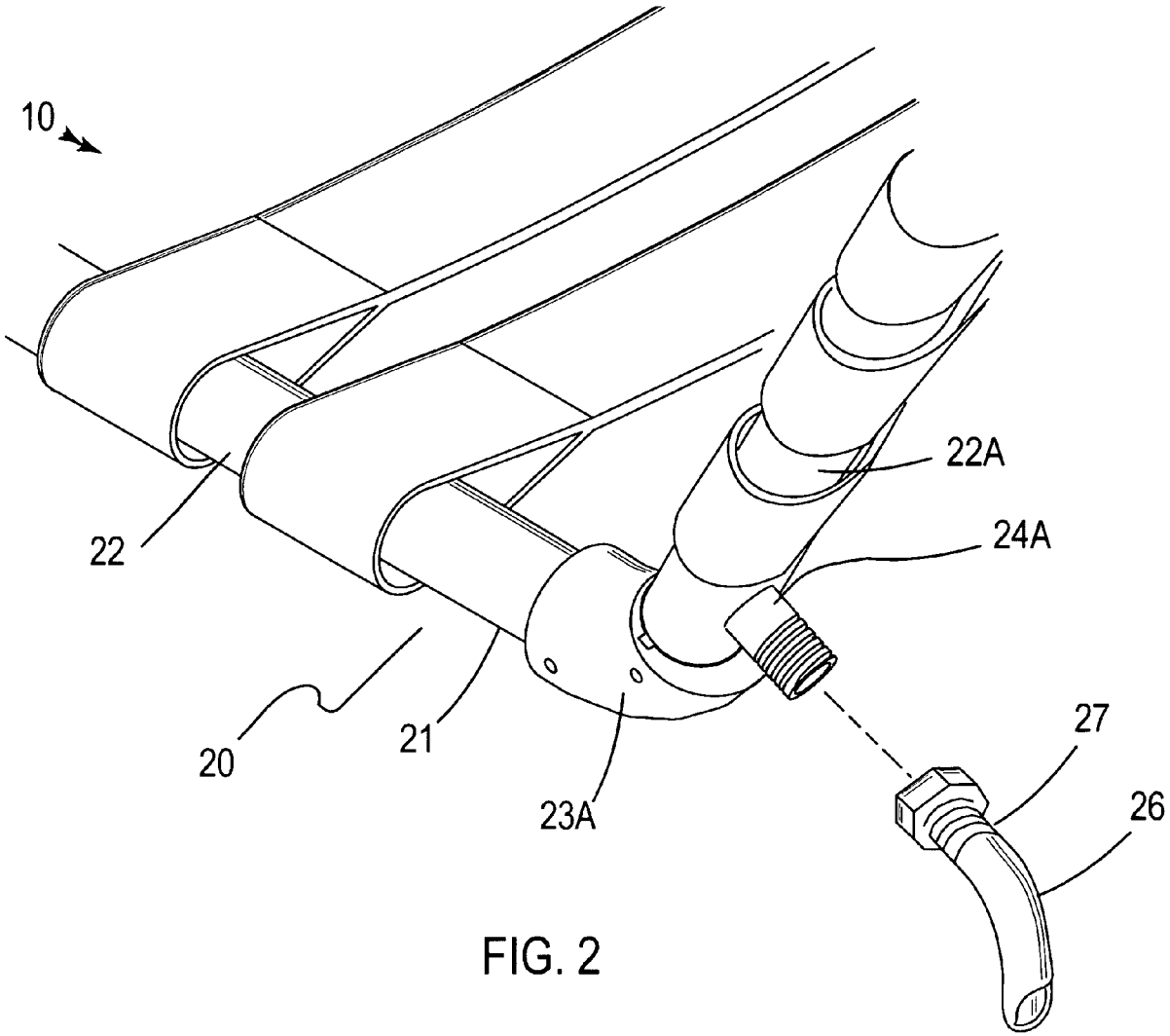
FIG. 2 is an enlarged perspective view of the one water port, as indicated by Arrow 2 in FIG. 1.
Figure 3:
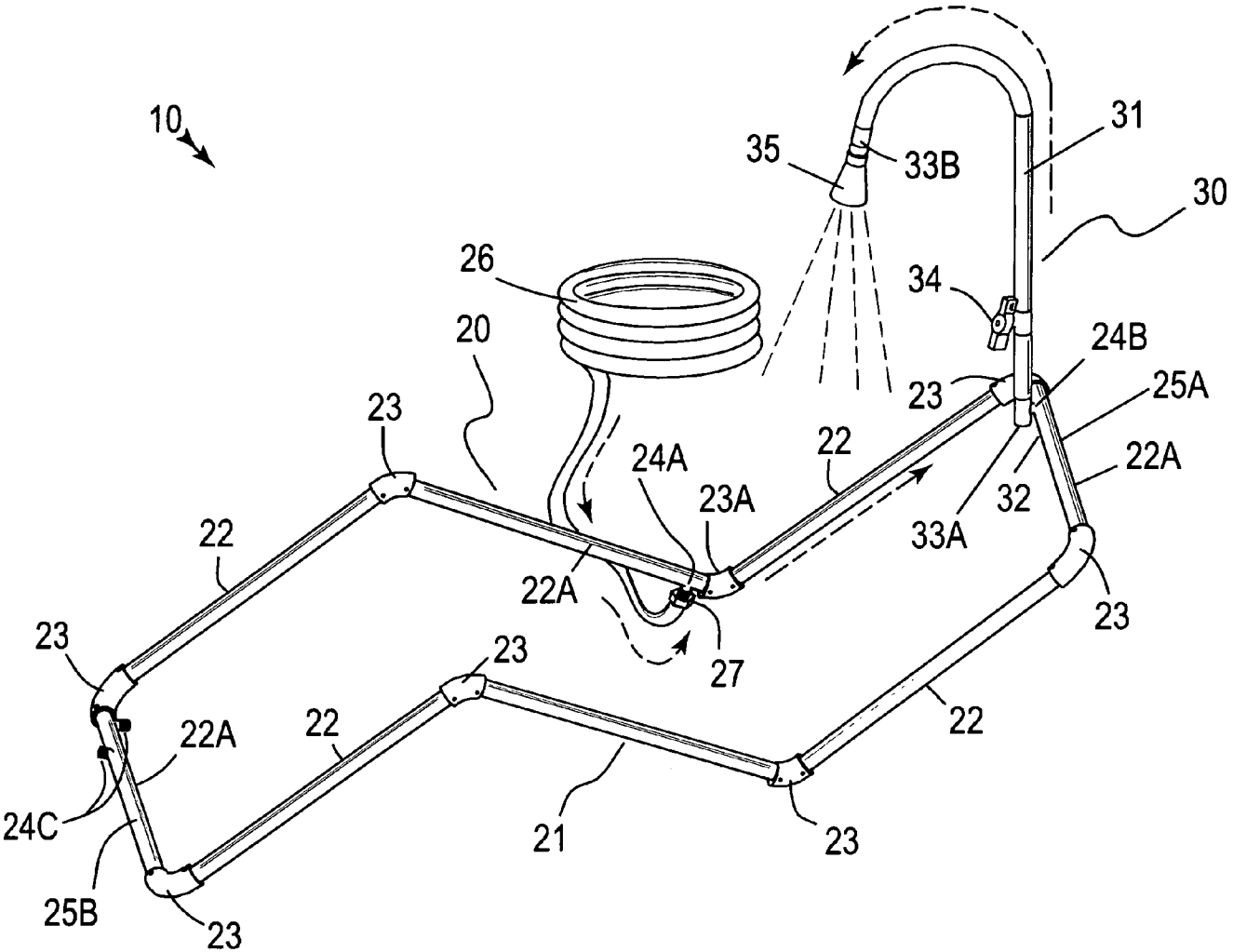
FIG. 3 is a perspective view of the tubular frame shown in FIG. 1.

The assembly of this invention is referred to generally in FIGS. 1-3 by the reference numeral 10 and is intended to provide a combined lounge chair and water misting dispensers. It should be understood that the assembly 10 may be used to provide mist dispensing to many different types of chairs and should not be limited in use to only lounge chairs.

Referring initially to FIGS. 1 through 3, the apparatus 10 includes a lounge chair 20 including a hollow tubular frame 21 that is suitably sized and shaped for effectively supporting an entire body of a user thereon. Of course, the tubular frame 21 may be provided in a variety of alternate configurations, not just in lounge chair types, as is obvious to a person of ordinary skill in the art. Such a tubular frame 21 includes a plurality of hollow shafts 22 and a plurality of hollow couplings 23 in fluid communication therewith, which is essential such that water 11 effectively flows in a unidirectional path directly through, without the use intervening elements, an entire surface area of the hollow shafts 22 and the hollow couplings 23. The couplings 23 are coextensively shaped for advantageously and conveniently being interchangeably detachable to alternate portions of the tubular frame 21.

Again referring to FIGS. 1 through 3, selected ones 22A of the hollow shafts 22 include a water port 24 monolithically formed therewith. Such water ports 24 are coextensively shaped for effectively receiving multiple ones of the flexible hoses 26 (described herein below) during operating conditions. The one water port 24A is situated adjacent to one of the couplings 23A and adjacent to an arm of the user, which is crucial so that the flexible hose 26 can advantageously and conveniently be reached by the user while the user is resting on the lounge chair 20. The other water port 24B is situated adjacent to a head of the user at a proximal end 25A of the tubular frame 21, which is critical and convenient for effectively allowing the user to selectively position the water discharging mechanism 30 (described herein below) without having to move away from the lounge chair 20. A flexible hose 26 has opposed end portions 27 directly conjoined, without the use of intervening elements, to one of the water ports 24 and to an external water supply source respectively, which is vital for effectively introducing fresh water into the tubular frame 21. A secondary pair of water ports 24C are attached to the distal end 25B of the tubular frame 21. Such a pair of water ports 24C advantageously and conveniently allows the user to simultaneously attach a plurality of water discharging mechanisms 30 to the proximal 25A and distal 25B ends of the tubular frame 21, as is best shown in FIG. 1. This is an important feature for allowing a user to selectively wet both or either of their upper and lower body regions, respectively.

Referring to FIGS. 1 and 2, a mechanism 30 is included for discharging the water 11 outwardly and away from the frame 21 such that the water 11 is conveniently dispensed in a fine mist over the user's body while the user is lying on the lounge chair 20. Such a water discharging mechanism 30 includes an elongated tubular rod 31 that has a threaded opening 32 formed at a bottom end 33A thereof. The tubular rod 31 is removably and threadably engageable directly, without the use of intervening elements, with another water port 24B such that the tubular rod 31 and the frame 21 become adapted in fluid communication with each other. A discharge spout 34 is monolithically connected with a top end 33B of the tubular rod 31. Such a spout 34 has an arcuate shape for effectively directing and depositing the water mist 11 directly onto, without the use of intervening elements, the user's body while the tubular rod 31 extends vertically upward along and over the user's body. A rotary shut-off valve 35 is operably connected directly, without the use of intervening elements, to the tubular rod 31 and disposed upstream of the other water port 24B, which is essential such that the operator can conveniently selectively toggle the water discharge mechanism 30 between operating and non-operating modes while the water supply source is retained at an on position. Such a shut-off valve 35 is spaced downstream from the spout 34.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A lounge chair assembly for providing cooling and refreshing mist during operating conditions, said lounge chair assembly comprising:

a lounge chair comprising a hollow tubular frame suitably sized and shaped for supporting an entire body of a user thereon, said tubular frame including a plurality of hollow shafts and a plurality of hollow couplings in fluid communication therewith such that water flows in a unidirectional path directly through an entire surface area of said hollow shafts and said hollow couplings, selected ones of said hollow shafts include a water port monolithically formed therewith;

a flexible hose having opposed end portions directly conjoined to one of said water ports and an external water supply source, respectively, for introducing fresh water into said tubular frame; and means for discharging the water outwardly and away from said frame such that the water is dispensed in a fine mist over the user body while the user is lying on said lounge chair;

said water discharging means comprising:

an elongated tubular rod having a threaded opening formed at a bottom end thereof, said tubular rod being removably and threadably engageable directly with another of said water ports such that said tubular rod and said frame become adapted in fluid communication with each other;

a discharge spout monolithically connected with a top end of said tubular rod, said spout; having an arcuate shape for directing and depositing the water mist directly onto the user body while said tubular rod extends vertically upward along and over the user body; and a rotary shut-off valve operably connected directly to said tubular rod and disposed upstream of said another water port such that the operator can selectively toggle said water discharge means between operating and non-operating modes while the water supply source is retained at an on position;

wherein said rotary valve is spaced from said flexible hose.

2. The assembly of claim 1, wherein said one water port is situated adjacent one said couplings and adjacent to an arm of the user so that said flexible hose can be reached by the user while the user is resting on said lounge chair.

3. The assembly of claim 1, wherein said another water port is situated adjacent a head of the user for allowing the user to selectively position said water discharging means without having to move away from said lounge chair.

4. The assembly of claim 1, wherein said shut-off valve is spaced downstream from said spout.

5. A lounge chair assembly for providing cooling and refreshing mist during operating conditions, said lounge chair assembly comprising:

a lounge chair comprising a hollow tubular frame suitably sized and shaped for supporting an entire body of a user thereon, said tubular frame including a plurality of hollow shafts and a plurality of hollow couplings in fluid communication therewith such that water flows in a unidirectional path directly through an entire surface area of said hollow shafts and said hollow couplings, wherein said couplings are coextensively shaped for being interchangeably detachable to alternate portions of said tubular frame, selected ones of said hollow shafts include a water port monolithically formed therewith;

a flexible hose having opposed end portions directly conjoined to one of said water ports and an external water supply source, respectively, for introducing fresh water into said tubular frame; and means for discharging the water outwardly and away from said frame such that the water is dispensed in a fine mist over the user body while the user is lying on said lounge chair;

said water discharging means comprising:

an elongated tubular rod having a threaded opening formed at a bottom end thereof, said tubular rod being removably and threadably engageable directly with another of said water ports such that said tubular rod and said frame become adapted in fluid communication with each other;

a discharge spout monolithically connected with a top end of said tubular rod, said spout having an arcuate shape for directing and depositing the water mist directly onto the user body while said tubular rod extends vertically upward along and over the user body; and a rotary shut-off valve operably connected directly to said tubular rod and disposed upstream of said another water port such that the operator can selectively toggle said water discharge means between operating and non-operating modes while the water supply source is retained at an on position;

wherein said rotary valve is spaced from said flexible hose.

6. The assembly of claim 5, wherein said one water port is situated adjacent one said couplings and adjacent to an arm of the user so that said flexible hose can be reached by the user while the user is resting on said lounge chair.

7. The assembly of claim 5, wherein said another water port is situated adjacent a head of the user for allowing the user to selectively position said water discharging means without having to move away from said lounge chair.

8. The assembly of claim 5, wherein said shut-off valve is spaced downstream from said spout.

9. A lounge chair assembly for providing cooling and refreshing mist during operating conditions, said lounge chair assembly comprising:

a lounge chair comprising a hollow tubular frame suitably sized and shaped for supporting an entire body of a user thereon, said tubular frame including a plurality of hollow shafts and a plurality of hollow couplings in fluid communication therewith such that water flows in a unidirectional path directly through an entire surface area of said hollow shafts and said hollow couplings, wherein said couplings are coextensively shaped for being interchangeably detachable to alternate portions of said tubular frame; selected ones of said hollow shafts include a water port monolithically formed therewith;

a flexible hose having opposed end portions directly conjoined to one of said water ports and an external water supply source, respectively, for introducing fresh water into said tubular frame, wherein said water ports are coextensively shaped for receiving multiple ones of said flexible hose during operating conditions; and means for discharging the water outwardly and away from said frame such that the water is dispensed in a fine mist over the user body while the user is lying on said lounge chair;

said water discharging means, comprising:

an elongated tubular rod having a threaded opening formed at a bottom end thereof, said tubular rod being removably, and threadably engageable directly with another of said water ports such that; said tubular rod and said frame become adapted in fluid communication with each other;

a discharge spout monolithically connected with a top end of said tubular rod, said spout having an arcuate shape for directing and depositing the water mist directly onto the user body while said tubular rod extends vertically upward along and over the user body; and a rotary shut-off valve operably connected directly to said tubular rod and disposed upstream of said another water port such that the operator can selectively toggle said water discharge means between operating and non-operating modes while the water supply source is retained at an on position;

wherein said rotary valve is spaced from said flexible hose.

10. The assembly of claim 9, wherein said one water port is situated adjacent one said couplings and adjacent to an arm of the user so that said flexible hose can be reached by the user while the user is resting on said lounge chair.

11. The assembly of claim 9, wherein said another water port is situated adjacent a head of the user for allowing the user to selectively position said water discharging means without having to move away from said lounge chair.

12. The assembly of claim 9, wherein said shut-off valve is spaced downstream from said spout.

* * * * *